US006672490B2

(12) United States Patent
Renard et al.

(10) Patent No.: US 6,672,490 B2
(45) **Date of Patent: *Jan. 6, 2004**

(54) GROOVED REFRACTORY TUBE FOR METALLURGICAL CASTING, ASSEMBLY OF REFRACTORY COMPONENTS AND CASTING INSTALLATION INCORPORATING SUCH AN ASSEMBLY

(75) Inventors: Jean-Luc Renard, Saint-Symphorien (BE); Luigi Borgosano, Quaregnon (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/221,013

(22) PCT Filed: Mar. 5, 2001

(86) PCT No.: PCT/BE01/00035

§ 371 (c)(1),
(2), (4) Date: Sep. 6, 2002

(87) PCT Pub. No.: WO01/66284

PCT Pub. Date: Sep. 13, 2001

(65) Prior Publication Data

US 2003/0020216 A1 Jan. 30, 2003

(30) Foreign Application Priority Data

Mar. 7, 2000 (EP) ..... 00870037

(51) Int. Cl.[7] ..... B22D 41/08
(52) U.S. Cl. ..... 222/606; 222/600
(58) Field of Search ..... 222/600, 606, 222/607, 603

(56) References Cited

U.S. PATENT DOCUMENTS

| | | | | | |
|---|---|---|---|---|---|
| 3,887,117 A | | 6/1975 | Fehling | | |
| 4,576,317 A | | 3/1986 | Wenger | | |
| 5,390,902 A | * | 2/1995 | Szadkowski | ..... | 222/603 |
| 5,670,075 A | * | 9/1997 | Vassilicos | ..... | 222/603 |
| 5,866,022 A | * | 2/1999 | Hall | ..... | 222/600 |

FOREIGN PATENT DOCUMENTS

| | | | | | |
|---|---|---|---|---|---|
| FR | 2757431 A | | 6/1998 | | |
| JP | 2-235565 A | | 9/1990 | | |
| JP | 405008021 A | * | 1/1993 | ..... | 222/600 |
| JP | 405115964 A | * | 5/1993 | ..... | 222/600 |
| WO | WO 92/20480 A1 | | 11/1992 | | |

* cited by examiner

*Primary Examiner*—Scott Kastler
(74) *Attorney, Agent, or Firm*—James R. Williams; Robert S. Klemz, Jr.; Donald M. Satina

(57) ABSTRACT

The present invention relates to a grooved refractory pouring tube for pouring a molten metal between an upper metallurgical vessel and a lower metallurgical vessel, a refractory assembly incorporating such a pouring tube, and a casting installation incorporating such an assembly. This refractory pouring tube forms a portion (12) of a pouring channel and includes at least a first contact face (14) capable of bearing against a second contact face (11) of another refractory component (9) forming an adjacent portion of the pouring channel and provided with an injection groove (17) forming, in conjunction with the first contact face (14), a fluid injection channel at least partially encircling the said channel, the said pouring tube (4) being arranged to be displaced in a predefined trajectory along which the first contact face (14) slides and remains in bearing contact against the second contact face (11), whilst the portion (12) of the pouring channel formed by the said pouring tube intercepts a determinate part (23) of the injection groove.

4 Claims, 3 Drawing Sheets

Figure 1:
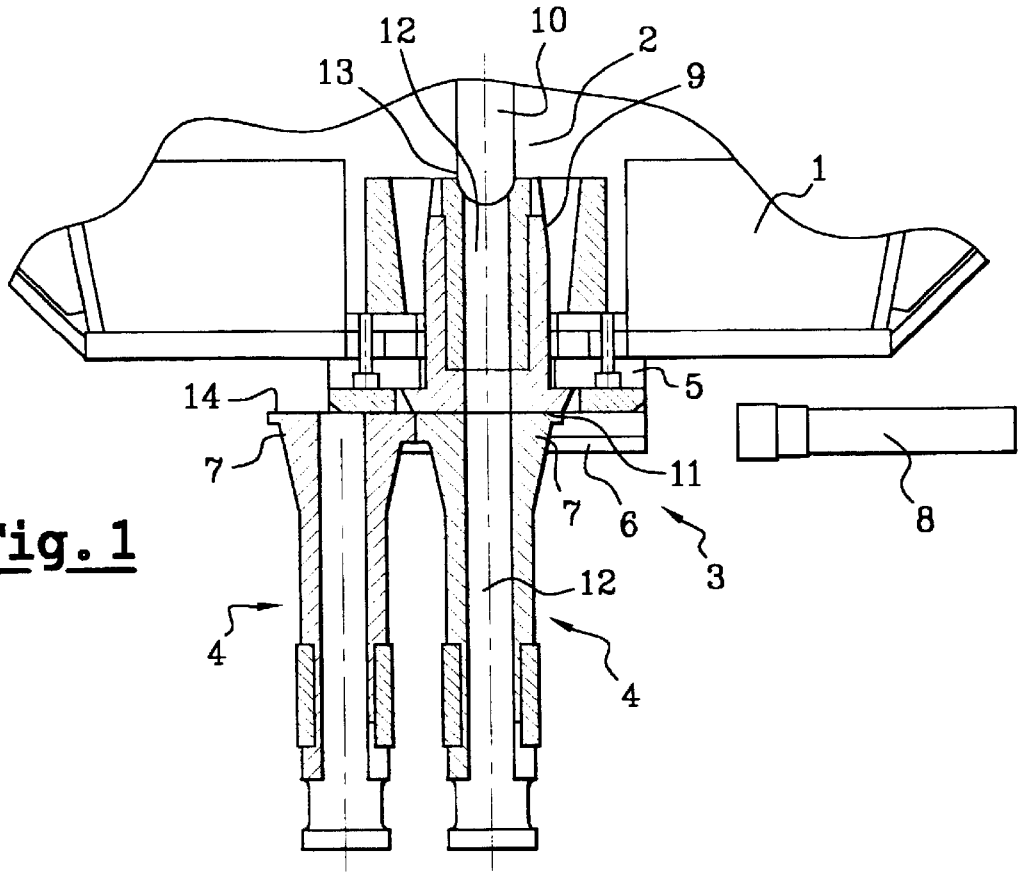

GROOVED REFRACTORY TUBE FOR METALLURGICAL CASTING, ASSEMBLY OF REFRACTORY COMPONENTS AND CASTING INSTALLATION INCORPORATING SUCH AN ASSEMBLY

The present invention relates to a grooved refractory component, and more particularly to a pouring tube, for pouring a molten metal between an upper metallurgical vessel and a lower metallurgical vessel, a refractory assembly incorporating such a component, and a casting installation incorporating such an assembly.

It is known that the continuous casting of steel calls for the filling of successive metallurgical vessels, notably a ladle, a tundish and ingot moulds, and that during its passage from an upper metallurgical vessel to a lower metallurgical vessel, the metal must as far as possible be kept out of all contact with the ambient air.

To this end, a pouring shroud or a submerged entry nozzle made of refractory material forms an extension to the pouring orifice of the upper vessel (respectively the ladle or tundish), and enters the bath of molten metal present in the lower vessel (respectively the tundish or ingot mould), so that the molten metal passes from the ladle to the tundish or from the tundish to the ingot mould without ever being exposed to the ambient air.

The pouring orifice of the upper vessel incorporates an inner nozzle in refractory material, which opens below this vessel via a contact surface designed to mate with a contact surface on the pouring shroud or submerged entry nozzle, thereby forming a joint face between these two components.

Conventionally, a casting installation also includes means of regulating the flow of the molten metal. These means may consist of a stopper rod which enters the metal bath of the upper vessel opposite the pouring orifice and whose degree of immersion in the said metal bath determines the opening of the said pouring orifice. Alternatively, use may also be made of a slide valve incorporating a set of refractory plates each having an orifice. These plates are normally located between the inner nozzle and the pouring shroud or the submerged entry nozzle. The degree of alignment of the orifices in adjacent plates determines the flow of molten metal.

A continuous casting installation therefore includes numerous assembled refractory components, the interfaces between which are formed by contact surfaces that may be planar or non-planar, as indicated for example in document U.S. Pat. No. 5,984,153.

It is known that the reductions in cross-section which occur along the molten metal pouring channel produce considerable negative pressure which can in turn lead to an induction of air. To avoid the penetration of air through the joint surface between two adjacent refractory components, conventional practice involves injecting an inert fluid, more particularly an inert gas such as argon, into an injection groove formed in the contract surface of one of the components and which delineates, in conjunction with the contact surface of the other component, a gas injection channel which nearly completely encircles the molten metal pouring orifice.

The risks of the metal coming into contact with the ambient air are thus effectively reduced during its passage from the upper vessel to the lower vessel.

More recently, documents WO 98/17420 and WO 98/1741 have also shown that the injection channel can effectively perform the additional function of allowing the injection of a sealing agent, such as graphite for example, to fill cracks propagating from the pouring orifice in the contact surface of one of the components, or score marks or scratches oriented in the general direction of movement of one of the components during its replacement. The sealing agent, which is conveyed by a carrier fluid, limits damage to the refractory around the cracks and/or score marks or scratches, thereby preventing the induction of air through these. The injection channel may be open or closed. In the description which follows, the terms injection channel or injection groove will be used equally to describe a channel or groove intended for the injection of an inert gas alone or a sealing agent in a carrier fluid.

The injection channel is therefore very useful. The applicant has found, however, that in certain cases this channel may itself become clogged, i.e. blocked.

In particular, this phenomenon has been observed in the case where the injection groove is formed in a surface of a refractory pouring tube bearing against the surface of another refractory component (a pouring tube) intended to be replaced during casting operations. For example, when the injection groove is formed in the lower surface of the inner nozzle bearing against the upper surface of a pouring shroud or a submerged entry nozzle.

Although the invention is clearly not limited to this particular case, for reasons of convenience it will be described in the description which follows with reference to an injection groove formed in the lower face of an inner nozzle bearing against the upper face of a submerged entry nozzle.

Replacement of the submerged entry nozzle can be carried out, in a known manner, by positioning a new submerged entry nozzle beside the submerged entry nozzle to be replaced, then simultaneously moving the two nozzles, allowing the new nozzle to displace the worn one and take its place beneath the inner nozzle.

Prior to each replacement, the tundish pouring orifice is closed off, but it is possible for a certain quantity of molten metal to remain at the joint surface, at the interface between the pouring orifices of the inner nozzle and the submerged entry nozzle. This metal is drawn into the joint surface as the nozzle is moved, and accumulates in the inert gas injection groove thereby blocking it, which renders it ineffective both in terms of the admission of ambient air and in terms of the treatment of cracks and score marks or scratches by means of a sealing agent conveyed by the carrier fluid.

The aim of the present invention is to remedy this shortcoming in a simple and economic manner.

The object of the present invention is therefore a refractory pouring tube forming part of a pouring channel and including at least a first contact face capable of bearing against a second contact face of another refractory component forming an adjacent portion of the pouring channel and provided with an injection groove forming, in conjunction with the first contact face, a fluid injection channel at least partially encircling the said pouring channel, the said pouring tube being arranged to be displaced in a predefined trajectory along which the first contact face slides and remains in bearing contact against the second contact face, whilst the portion of the pouring channel formed by the said pouring tube intercepts a determinate part of the injection groove, characterised in that the first contact face incorporates an additional groove positioned so that, in the pouring position, it is located in proximity to the determinate part of the groove and communicates with this groove at least on either side of this determinate part.

The refractory pouring tube is for example a submerged entry nozzle or a pouring shroud. The additional groove formed in the contact face allows the injected fluid to bypass the obstructed part of the injection groove.

In this way, even if the injection groove is obstructed, the injected fluid is able to circulate completely around the pouring orifice and form a barrier to the ambient air.

An advantageous characteristic of the invention is that the additional groove is formed in the refractory pouring tube which is regularly replaced, so that the injection channel is cleared each time this pouring tube is replaced, unlike the situation prevailing in the current state of the art where replacement of the refractory pouring tube causes the injection channel to become obstructed.

It is to be noted that the additional groove cannot be too large; for example, it cannot completely encircle the pouring orifice (such as in the tube disclosed in document WO 92/20480), otherwise, the additional groove could not serve as a bypass for the injected fluid where a part of the injection groove is obstructed. On the contrary, a groove encircling completely the pouring orifice would form a shortcut for the injected fluid, preventing thus the metal from being efficiently protected by the injected fluid. Preferably, the additional channel is blind so that the pressure in the injection channel is maintained.

According to a particular characteristic, the additional groove is formed to cover the outlet of a delivery and/or discharge conduit (if any) of the fluid injection channel. This outlet is thus better able to clear itself in case of obstruction.

Preferably, the additional groove should have a width such that, when the groove is at the level of the pouring orifice (for example when the tube is changed), it does not communicate with the injection groove. Thus, if some molten metal remains at the interface between the pouring orifices of the inner nozzle and the submerged entry nozzle, it will not reach the injection groove. Therefore, according to an advantageous characteristic of the invention, the additional groove is shorter than the minimum width between opposite sections of the injection groove on either side of the pouring orifice at the level of the pouring orifice.

According to another particular characteristic, the first contact face incorporates a second groove essentially parallel to the additional groove. This second groove may be located, relative to the additional groove, on the other side of the pouring channel. The function of this second groove, referred to below as the scraper groove, is to scrape the contact face incorporating the injection groove to clean it of any dirt or extraneous material liable to impair the contact quality between the two faces, before the new refractory pouring tube is placed in position.

Advantageously, the scraper groove is symmetrical with the additional groove relative to the pouring channel. The two grooves are therefore interchangeable, which makes it possible to insert the replacement pouring tube without needing to take into account its direction of movement. According to its position relative to the injection groove, each groove performs the function of additional groove or scraper groove.

The object of the present invention is also an assembly of refractory components forming a pouring channel, a first component of the assembly incorporating at least a first contact face bearing against a second contact face of an adjacent refractory component, with a groove being provided in the second contact face to form, in conjunction with the first contact face, a fluid injection channel at least partially encircling the said pouring channel, characterised in that the first component is a refractory pouring tube such as that described above.

According to a particular characteristic of this assembly, one or certain of the refractory components incorporate a delivery conduit and, where appropriate, a discharge conduit for the fluid injection channel.

The object of the present invention is also a casting installation including an upper metallurgical vessel and a lower metallurgical vessel, connected by a pouring channel defined notably by an assembly of refractory components as described above, the installation also including a fluid source connected to the delivery line of the fluid injection channel.

In a particular embodiment, the casting installation also includes a means of injecting a sealing agent into the fluid.

Figure 2:
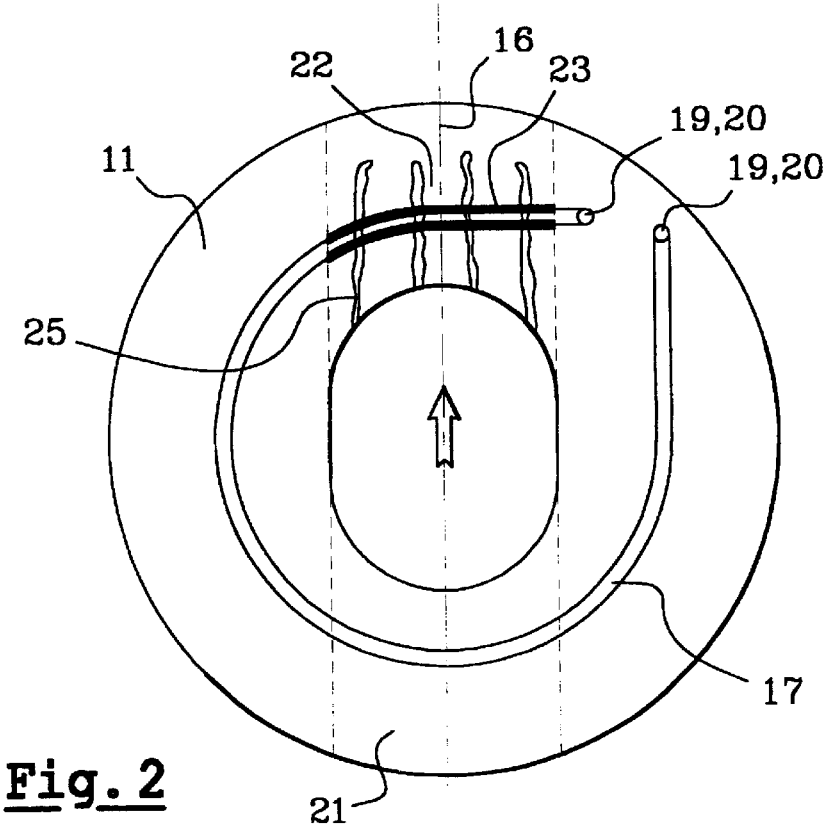
Figure 3:
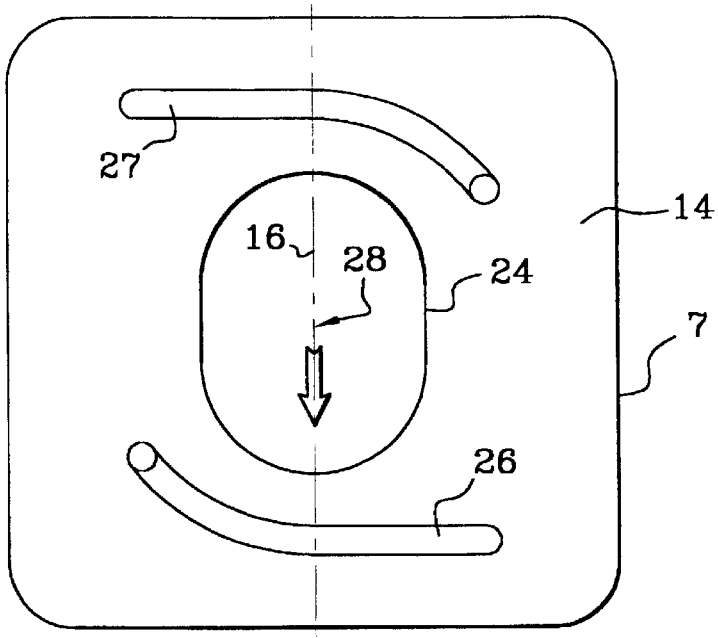
Figure 4:
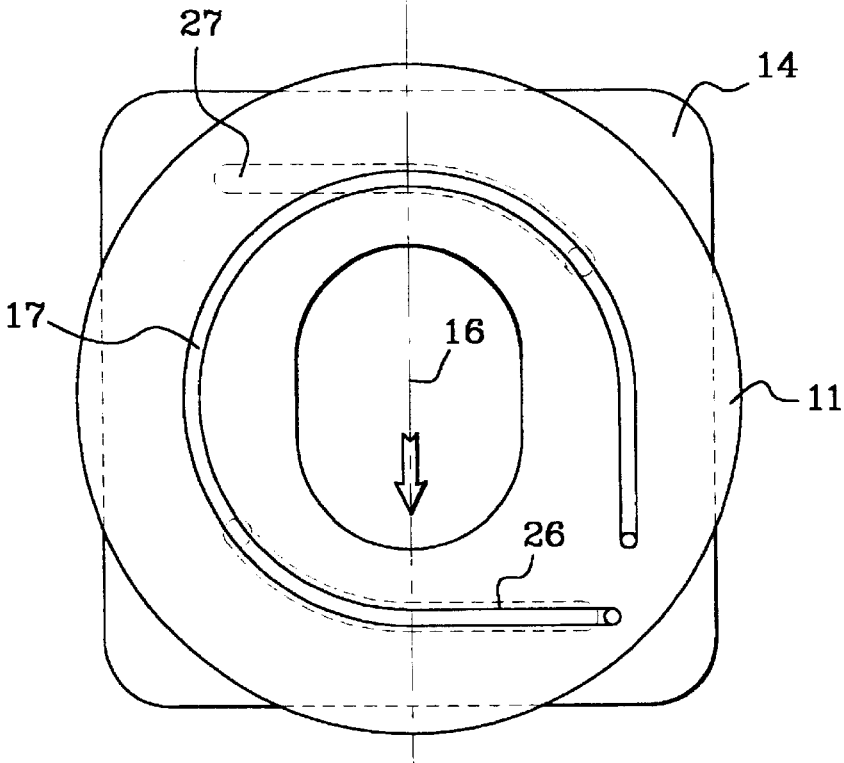
Figure 5:
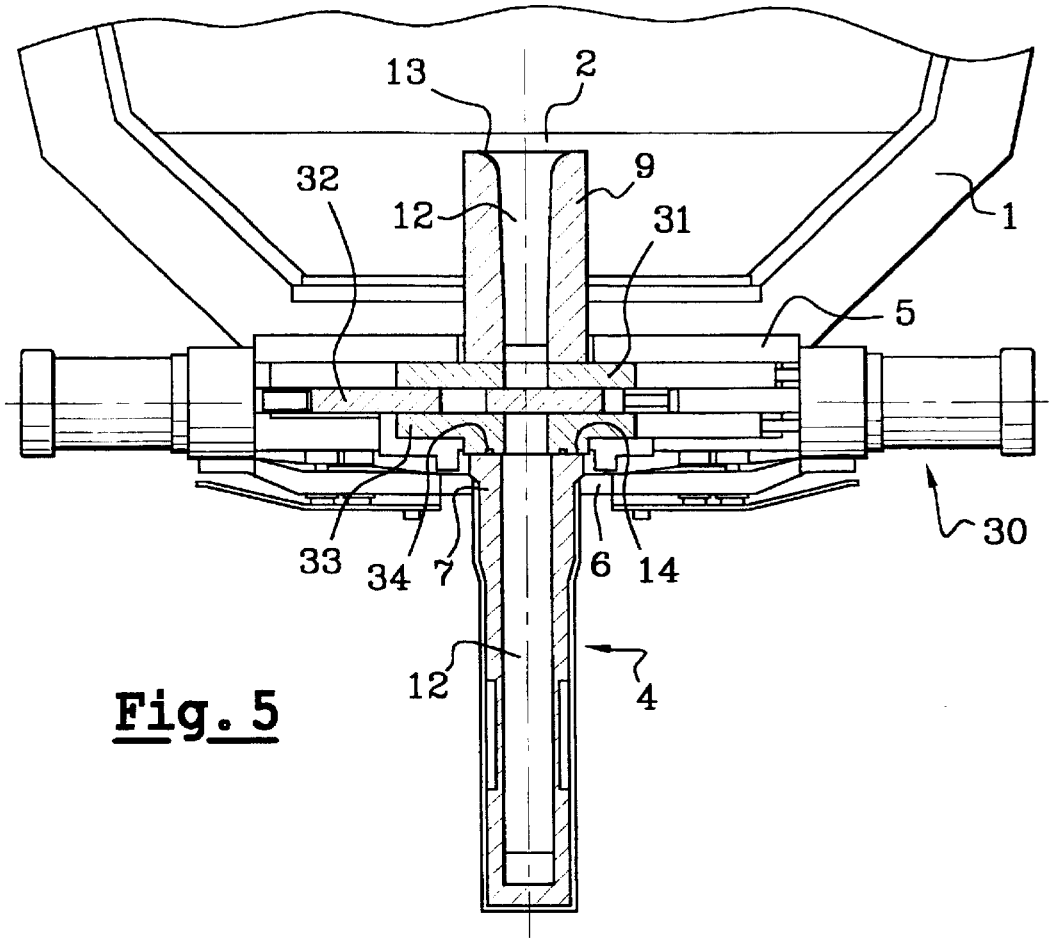
Figure 6:
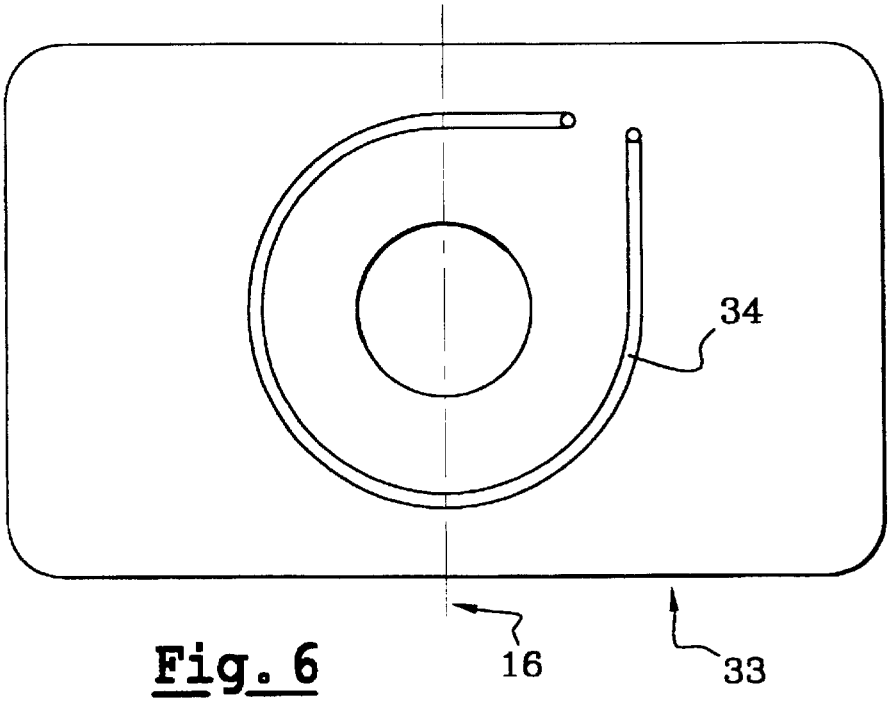

In order to better explain the invention, a mode of implementation given by way of example which does not limit the scope of the invention will be described below with reference to the attached drawing in which:

FIG. 1 is an axial cross-section of an inner nozzle of a tundish and a submerged entry nozzle, FIG. 2 is a view on the underside of the contact face of the inner nozzle, FIG. 3 is an upper view on the contact face of the submerged entry nozzle, FIG. 4 shows the contact faces of the inner nozzle and the submerged entry nozzle superimposed, FIG. 5 is a view similar to FIG. 1 showing a slide valve interposed between the inner nozzle and the submerged entry nozzle, FIG. 6 is a view on the underside of the bottom plate of a slide valve similar to the view in FIG. 2.

FIG. 1 shows the bottom wall 1 of a tundish, in a region surrounding one of its pouring orifices 2.

The tundish is fitted with a device 3 for changing the tube 4 which includes a mounting plate 5 integral with the bottom wall of the tundish, a guide-rails 6 accommodating the collars 7 of two submerged entry nozzles 4 which are held in proximity to the mounting plate 5, and a cylinder to push the two submerged entry nozzles 4 in the guide-rails 6. The pouring orifice 2 of the tundish incorporates an inner nozzle 9 in refractory material which passes through the mounting plate 5 and is supported at the lower face of the latter by the contact face 11 surrounding the pouring orifice and forming a flat contact surface 11.

The guide-rails 6 holds the two submerged entry nozzles 4 against the contact face 11 of the inner nozzle at an elevated pressure equivalent to a weight of several tonnes. In FIG. 1, the submerged entry nozzle 4 on the right is the one which forms, in conjunction with the inner nozzle 9, a portion of the pouring channel 12 for the molten metal. The nozzle on the left is the one which has just been replaced by moving in the guide-rails 6 under the action of the cylinder 8.

A stopper rod 10 can be applied against the upper orifice 13 of the inner nozzle to regulate the metal flow or to interrupt pouring, notably to allow replacement of the submerged entry nozzle.

FIG. 2 illustrates the contact face 11 of the inner nozzle.

The pouring orifice has an elongated cross-section oriented in a direction 16 which is parallel to the guide-rails 6, i.e. the direction in which the submerged entry nozzles are moved when the older of the two nozzles is being replaced.

Around the pouring orifice, the contact face incorporates an injection groove 17 in the form of a three-quarter partial circle extending into straight sections of which the ends 19 are close together but which are not in communication with each other. One end 19 communicates with the outlet 20 of a delivery line, or where applicable, a discharge line, formed in the inner nozzle 9. Too much importance should not be attached to the actual shape of the groove 17. Preferably, its ends 19 must be close together so that the area not circumscribed by the groove is reduced to a minimum, and relatively close to the edge so that the outlet of the fluid delivery and, where applicable, discharge line is accessible. This function is fulfilled by the combination of straight and circular portions.

In FIG. 3, it can be seen that each submerged entry nozzle 4 delineates a portion 24 of elongated transverse cross-section (in direction 16) of the pouring channel, and that its collar 7 is rectangular in shape to enable it to be guided in the guide-rails 6 of the submerged entry nozzle changer 3.

The contact face 14 of each submerged entry nozzle, formed by the upper face (according to the orientation in FIG. 1) of its collar 7, covers the injection groove 17 of the inner nozzle 9 when the submerged entry nozzle 4 is in the working position, and thus forms an injection channel for fluid and/or sealing agent to prevent the admission of ambient air into the pouring channel and/or to prevent damage to the refractory material constituting the inner nozzle around its cracks or score marks 25.

When the submerged entry nozzle 4 is replaced, the contact faces 14 of the two submerged entry nozzles slide in the direction 14 against the contact face 11 of the inner nozzle. Maximum friction occurs in areas 21 and 22 defined by the dotted lines (in FIG. 2), which correspond to the sections passed over by the pouring orifices of the submerged entry nozzles as they move.

Droplets of molten metal present at the interface between the pouring orifices of the inner nozzle and the submerged entry nozzle are drawn into the area 22 located beside the pouring orifice in the direction of movement of the submerged entry nozzles, and accumulate in the injection groove, which causes obstruction of a determinate part 23 (marked by a thick line) of the said injection groove corresponding to its intersection with the said area 22.

Two additional grooves 26 and 27 are formed in the contact face 14 of each submerged entry nozzle 4, at locations corresponding—when the said submerged entry nozzle is in the pouring position—to the parts of the injection groove 17 contained within the areas 21 and 22 defined by the dotted lines (in FIG. 2) on the contact face of the inner nozzle, i.e. the regions passed over by the injection orifices of the submerged entry nozzles as they move.

In the example shown, the two additional grooves 26 and 27 are centrally symmetrical about the centre 28 of the contact face, which is equivalent to the centre of the transverse cross-section of the pouring channel, by the fact that each submerged entry nozzle can be used in the two possible positions of engagement of its rectangular collar 7 in the guiderails 6.

In reality, only the additional groove 26 covering the determinate part 23 of the injection groove performs the function of clearing the injection channel.

In effect, when the said determinate part 23 of the injection groove 17 is obstructed, following the movement of two submerged entry nozzles, the fluid delivered to the injection channel is able to bypass the obstructed section of the injection groove 17 by circulating through the additional groove 26 of the submerged entry nozzle, which communicates with the said injection groove on either side of its obstructed part 23. The fluid is thus able to reach the rest of the injection channel to perform its function of preventing the admission of air and/or treating cracks and score marks or scratches.

Beyond its circular section covering the determinate part 23 of the injection groove, the additional groove 26 extends into a straight length which covers the straight section of the injection groove.

The second additional groove 27, which does not cover the determinate part 23 of the injection groove, nevertheless performs a scraping function on the contact face 11 of the inner nozzle during the movement of the two submerged entry nozzles.

The slide valve 30 in FIG. 5 is interposed between the inner nozzle 9 and the submerged entry nozzle 4 described previously.

This slide valve 30 is composed of a fixed upper plate 31, an intermediate mobile plate 32, and a fixed bottom plate 33.

As explained above, the inner nozzle 9 can incorporate an injection groove. In this case, the injection channel is formed with the upper face (relative to FIG. 4) of the fixed upper plate 31.

Other joint planes are formed between the fixed plates 31, 33 and the mobile plate 32 of the slide valve. As is known, other injection channels can be made in these joint planes to prevent the admission of air.

A joint surface is present between the lower fixed plate 33 and the submerged entry nozzle 4 which poses the same risks of damage as that described in reference to FIGS. 1 to 4, by the fact that replacements of the submerged entry nozzle 4 cause friction and risks of obstruction of an injection groove 34 formed in the lower face (relative to FIG. 4) of the lower fixed plate which in conjunction with the contact face of the submerged entry nozzle forms a fluid injection channel.

By reason of this risk, the additional grooves 26 and 27 of a submerged entry nozzle identical to that in FIG. 3 fulfil the same functions with regard to the fixed lower plate as in respect of the inner nozzle in FIG. 1.

Although the additional grooves have been described for submerged entry nozzles with reference to a flat joint surface at the outlet of a tundish, it is to be understood that the invention applies to any planar or non-planar interface between two refractory components forming a fluid injection channel between them.

With regard to FIG. 6, reference will be made mutatis mutandis to the description of FIG. 2, and the reference 34 designates an injection groove formed in the lower face (relative to FIG. 5) of the fixed bottom plate.

1. tundish bottom wall
2. pouring orifice
3. tube changing device
4. submerged entry nozzle
5. mounting plate
6. slide
7. tube collar
8. cylinder
9. inner nozzle
10. stopper rod
11. inner nozzle contact face
12. part of the pouring channel
13. upper orifice of the inner nozzle
14. tube contact face
16. direction X
17. injection groove
19. groove ends
20. opening of a delivery line or discharge line, respectively
21. area located ahead of the pouring orifice
22. area located after the pouring orifice
23. determinate part of the injection groove
24. portion of elongated transverse cross-section in direction X of the pouring channel of the submerged entry nozzle
25. cracks, score marks and scratches on the inner nozzle
26. additional groove covering the determinate part of the injection groove

27. second additional groove
28. centre of the contact face of the submerged entry nozzle
30. slide valve
31. fixed upper plate
32. mobile intermediate plate
33. fixed bottom plate
34. injection groove formed in the lower face (relative to FIG. 5) of the fixed bottom plate

What is claimed is:

1. A refractory pouring tube comprising an inner surface defining a first portion of a pouring channel and a first contact face capable of bearing against a second contact face of a second refractory component defining an adjacent portion of the pouring channel and provided with an injection groove capable of forming with the first contact face an injection channel substantially encircling the pouring channel, the pouring tube adapted to be displaced in a predefined trajectory along which the first contact face slides and remains in bearing contact against the second contact face while the first portion of the pouring channel intercepts a determinant part of the injection groove, the first contact face comprising an additional groove and a second groove, the additional groove located proximate to the determinate part and communicating with the injection groove at least on either side of the determinate part, and the second groove is essentially parallel to the additional groove and is located, relative to the additional groove, on the other side of the pouring channel.

2. A refractory pouring tube comprising an inner surface defining a first portion of a pouring channel and a first contact face capable of bearing against a second contact face of a second refractory component defining an adjacent portion of the pouring channel and provided with an injection groove capable of forming with the first contact face an injection channel substantially encircling the pouring channel, the pouring tube adapted to be displaced in a predefined trajectory along which the first contact face slides and remains in bearing contact against the second contact face while the first portion of the pouring channel intercepts a determinant part of the injection groove, the first contact face comprising an additional groove and a second groove, the additional groove located proximate to the determinate part and communicating with the injection groove at least on either side of the determinate part, and the second groove is symmetrical with the additional groove relative to the pouring channel.

3. The refractory pouring tube of claim 1, wherein the pouring tube comprises a submerged entry nozzle.

4. The refractory pouring tube of claim 1, wherein the additional groove comprises a blind groove.

* * * * *